US011918925B2

(12) United States Patent
Larberg MacLean et al.

(10) Patent No.: US 11,918,925 B2
(45) Date of Patent: Mar. 5, 2024

(54) CHOREOGRAPHED RIDE SYSTEMS AND METHODS

(71) Applicant: Universal City Studios LLC, Universal City, CA (US)

(72) Inventors: Lara Larberg MacLean, Orlando, FL (US); William Dale Mason, Camano Island, WA (US); Eric Alan Vance, Apopka, FL (US); Justin Michael Schwartz, Orlando, FL (US); Ross Alan Osterman, Winter Park, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 18/075,234

(22) Filed: Dec. 5, 2022

(65) Prior Publication Data

US 2023/0100263 A1 Mar. 30, 2023

Related U.S. Application Data

(63) Continuation of application No. 16/513,475, filed on Jul. 16, 2019, now Pat. No. 11,517,828.

(60) Provisional application No. 62/863,598, filed on Jun. 19, 2019.

(51) Int. Cl.
*A63G 31/02* (2006.01)
*A63G 31/00* (2006.01)

(52) U.S. Cl.
CPC ..... *A63G 31/02* (2013.01)

(58) Field of Classification Search
CPC ..... A63G 31/00; A63G 31/02; A63G 31/07; A63G 31/12; A63G 31/16
USPC ..... 472/43, 59–60
See application file for complete search history.

(56) References Cited

U.S. PATENT DOCUMENTS

| | | | |
|---|---|---|---|
| 583,109 | A | 5/1897 | Daniels |
| 797,347 | A | 8/1905 | Degenhardt |
| 925,402 | A | 6/1909 | Vangezell |
| 973,105 | A | 10/1910 | Chamberlain, Jr. |
| 1,230,998 | A | 6/1917 | Cramer |
| 1,399,582 | A | 12/1921 | Sayih |
| 2,535,862 | A | 12/1950 | Pewitt |
| 2,721,081 | A | 10/1955 | Sipior |
| 2,842,364 | A | 7/1958 | Hutchison |
| 5,403,238 | A | 4/1995 | Baxter et al. |

(Continued)

FOREIGN PATENT DOCUMENTS

WO 2019021009 A1 1/2019

OTHER PUBLICATIONS

PCT/US2020/037732 Invitation to Pay Additional Fees dated Sep. 14, 2020.

(Continued)

*Primary Examiner* — Kien T Nguyen
(74) *Attorney, Agent, or Firm* — Fletcher Yoder, P.C.

(57) ABSTRACT

A ride vehicle includes a riding assembly configured to carry a rider, a base configured to couple to the riding assembly, and a control system configured to control the coordination of movements of the ride vehicle with movements of separate ride vehicles. The base includes a surface movement system configured to move the ride vehicle along a surface, a vertical movement system configured to move the riding assembly vertically relative to the base, and a roll system configured to move the riding assembly angularly relative to the base.

20 Claims, 12 Drawing Sheets

(56) References Cited

U.S. PATENT DOCUMENTS

| | | | | |
|---|---|---|---|---|
| 5,558,581 | A | 9/1996 | Knijpstra | |
| 5,583,844 | A | 12/1996 | Wolf et al. | |
| 5,623,878 | A | 4/1997 | Baxter et al. | |
| 5,810,641 | A | 9/1998 | Lo | |
| 6,024,647 | A | 2/2000 | Bennett et al. | |
| 6,796,908 | B2 | 9/2004 | Weston | |
| 6,910,971 | B2 | 6/2005 | Alsenz | |
| 7,921,781 | B2 | 4/2011 | Baker et al. | |
| 8,303,426 | B2 | 11/2012 | Crawford et al. | |
| 8,313,389 | B2 | 11/2012 | Crawford et al. | |
| 8,371,227 | B2 | 2/2013 | Nemeth et al. | |
| 8,485,104 | B2 | 7/2013 | Nemeth et al. | |
| 8,517,848 | B2 | 8/2013 | Crawford et al. | |
| 8,678,940 | B2 | 3/2014 | Willcox | |
| 8,864,592 | B2 | 10/2014 | Baxter et al. | |
| 8,893,623 | B2 | 11/2014 | Gordon | |
| 9,014,965 | B2 | 4/2015 | King et al. | |
| 9,296,400 | B2 | 3/2016 | King et al. | |
| 2004/0192453 | A1 | 9/2004 | Esparza et al. | |
| 2013/0079169 | A1* | 3/2013 | Dietz | A63G 21/20 472/137 |
| 2014/0277849 | A1 | 9/2014 | Grant et al. | |
| 2016/0176421 | A1 | 6/2016 | King et al. | |
| 2018/0028924 | A1 | 2/2018 | Sawade et al. | |
| 2018/0120862 | A1 | 5/2018 | Dembinski et al. | |
| 2018/0265293 | A1 | 9/2018 | Zuckerman et al. | |

OTHER PUBLICATIONS

SG Office Action for Singapore Application No. 11202112973S dated Sep. 28, 2023.

* cited by examiner

CHOREOGRAPHED RIDE SYSTEMS AND METHODS

CROSS-REFERENCE TO RELATED APPLICATIONS

This application is a continuation of U.S. application Ser. No. 16/513,475, entitled "CHOREOGRAPHED RIDE SYSTEMS AND METHODS," filed Jul. 16, 2019, which claims priority from and the benefit of U.S. Provisional Application Ser. No. 62/863,598, entitled "CHOREOGRAPHED RIDE SYSTEMS AND METHODS," filed Jun. 19, 2019, each of which is hereby incorporated by reference.

BACKGROUND

The present disclosure relates generally to ride vehicles. More specifically, embodiments of the present disclosure relate to ride vehicles that may move about a coordinated ride path, relative to one another, and along multiple directions.

Some ride vehicles are ridden by users for transportation and/or entertainment purposes. For example, some amusement rides, such as carousels, and other structured ride systems include ride vehicles that move in circular patterns along fixed paths of a surface. During operation, the movement of the ride vehicles is typically restricted to the fixed paths along the ride surface. It is now recognized that such movement of the ride vehicles may detract from the users' experiences while riding the ride vehicles.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a ride vehicle includes a riding assembly configured to carry a rider, a base configured to couple to the riding assembly, and a control system configured to control the coordination of movements of the ride vehicle with movements of separate ride vehicles. The base includes a surface movement system configured to move the ride vehicle along a surface, a vertical movement system configured to move the riding assembly vertically relative to the base, and a roll system configured to move the riding assembly angularly relative to the base.

In an embodiment, a ride vehicle includes a riding assembly configured to carry a rider and a base configured to couple to the riding assembly. The base includes a surface movement system configured to move the ride vehicle along a surface and a riding assembly movement system configured to move the riding assembly with respect to the base. The ride vehicle also includes a ride vehicle control system configured to receive a signal indicative of a position of the ride vehicle from a sensor, determine that a distance between the position of the ride vehicle and a corresponding position along a ride path exceeds a threshold distance, and output a signal to the surface movement system indicative of instructions to adjust the position of the ride vehicle in response to determining that the distance exceeds the threshold distance.

In an embodiment, a ride system includes a plurality of trackless ride vehicles configured to traverse a surface and a ride control system. The ride control system is configured to send one or more choreographed ride paths to the plurality of trackless ride vehicles, detect respective positions of the plurality of trackless ride vehicles relative to one another and relative to the one or more choreographed ride paths within a ride area, and send a plurality of commands to the plurality of trackless ride vehicles to control movement of the plurality of trackless ride vehicles based on the respective positions of the plurality of trackless ride vehicles relative to one another and relative to the one or more choreographed ride paths.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
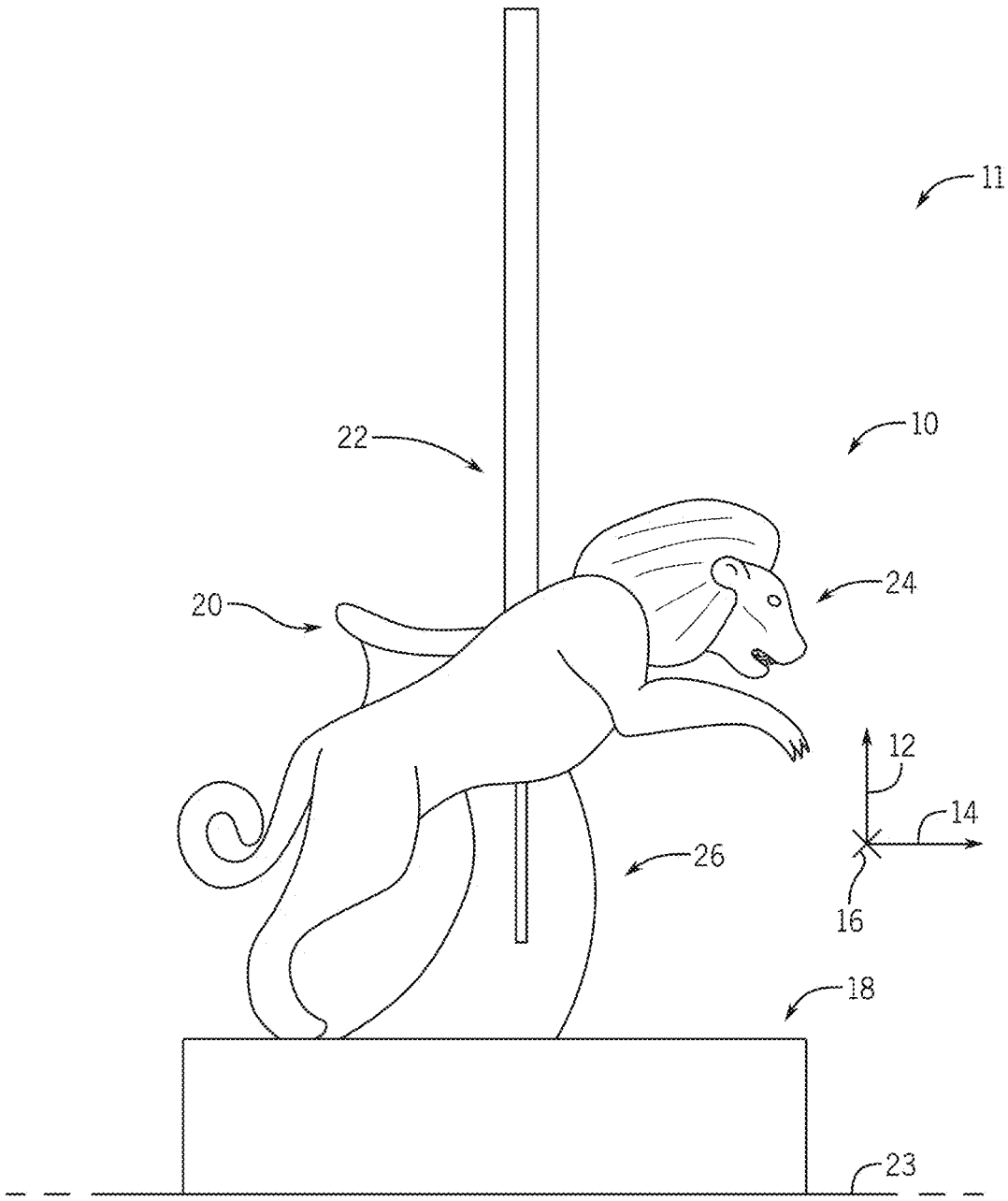
FIG. 1 is a side view of an embodiment of ride system including a ride vehicle, in accordance with an aspect of the present disclosure.

One or more specific embodiments will be described below. In an effort to provide a concise description of these embodiments, not all features of an actual implementation are described in the specification. It should be appreciated that, in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain ride systems include ride vehicles that may carry riders (e.g., users) within ride areas of the ride systems. Embodiments of the present disclosure are directed to ride vehicles that may move about ride paths within a ride system and move relative to one another. For example, a ride system may include multiple ride vehicles that may carry riders within the ride area to entertain and/or transport the riders. Movement of the ride vehicles may be choreographed along ride paths and/or with respect to one another and other portions of the ride system. Additionally, the ride vehicles may move in certain directions relative to a surface of the ride system while moving along the ride paths, and/or may include riding assemblies that may carry the riders and move relative to the surface of the ride system. For example, the ride vehicles may include mechanisms and portions (e.g., the riding assemblies) that may move vertically and/or horizontally in various directions (e.g., may move in any planar direction, may spin, and may turn) and that may roll.

In certain embodiments, the ride vehicle and/or the ride system may include a control system that controls movement of the ride vehicle within the ride area. For example, based on a position of the ride vehicle with respect to a ride path (e.g., based on an actual position of the ride vehicle relative to an intended position of the ride vehicle along the ride path), the control system may adjust a trajectory or traveled course of the ride vehicle. In some embodiments, as the ride vehicle travels within the ride area, certain factors may affect the trajectory of the ride vehicle, such as obstacles within the ride area, a weight of the rider on the ride vehicle, a weight of other items disposed on or part of the ride vehicle, obstructions attached to the ride vehicle that may be dragging behind, in front of, or the side of the ride vehicle, and/or rider inputs (e.g., a rider shifting their weight, a rider turning a steering wheel or adjusting the trajectory of the ride vehicle generally, a rider adjusting a speed of the ride vehicle, etc.). As such, the control system may adjust the trajectory or the traveled course of the ride vehicle to generally follow the ride path and to account for such factors.

Additionally, based on a position of the ride vehicle along the ride path (e.g., a progression of the ride vehicle along the ride path), the control system may control the horizontal movement, the vertical movement, and the roll of the ride vehicle or of the riding assembly of the ride vehicle. As such, the ride vehicles and ride systems described herein may move in various directions and in a choreographed manner for the transportation and/or entertainment of the riders. In certain embodiments, the choreographed movement of the ride vehicles may be viewed by people other than the riders, such as people waiting to ride the ride vehicles and/or an audience. As such, the choreographed movement of the ride vehicles may provide an entertaining attraction for the people viewing the ride system.

In some embodiments, the ride system may be an amusement ride system that may provide entertainment for the riders riding the amusement ride system and the people viewing the amusement ride system. The amusement ride system may have a particular theme, such that the ride paths of the ride vehicles and/or certain decorative aspects of the ride vehicles and the ride system generally match the theme.

Turning to the drawings, FIG. 1 is a side view of an embodiment of a ride vehicle 10 of a ride system 11. To facilitate discussion, the ride vehicle 10 and certain components of the ride vehicle 10 may be described with reference to a vertical axis or direction 12, a longitudinal axis or direction 14, and a lateral axis or direction 16. As illustrated, the ride vehicle 10 may include a base 18, a riding assembly 20 (e.g., a seat) coupled to the base 18, and a pole 22 extending from the base 18 generally along the vertical axis 12. The base 18 may move the ride vehicle 10 along a ride path and/or along a surface 23 of the ride system 11, and the riding assembly 20 may carry a rider (e.g., a user) of the ride vehicle 10. For example, the rider may ride the ride vehicle 10 for entertainment and/or transportation purposes. As illustrated, the riding assembly 20 is coupled to an ornamental feature 24 that resembles a lion. The ornamental feature 24 is coupled to the base 18 via a support 26. The ornamental feature 24 may provide the rider with an experience simulating an interaction with the ornamental feature 24, such as riding the lion in the illustrated embodiment. In some embodiments, the ornamental feature 24 may be another animal (e.g., a tiger, an elephant, a bird, fish), a character (e.g., a superhero, a storybook character, a unicorn), a structure, decorations, and/or an object. Alternatively, in certain embodiments, the ornamental feature 24 may be omitted from the ride vehicle 10 such that the riding assembly 20 is coupled to the base 18 via the support 26, or the riding assembly 20 may be integral to the base 18.

The ride vehicle 10 may include the pole 22 to provide an experience similar to a traditional ride vehicle, such as a carousel ride vehicle. As such, the pole 22 may be an ornamental feature that enhances the rider's experience while riding the ride vehicle 10. Additionally, the riding assembly 20 and/or the ornamental feature 24 may be coupled to the pole 22. For example, the pole 22 may support the riding assembly 20 and/or the ornamental feature 24, may couple the riding assembly 20 and/or the ornamental feature 24 to the base 18, and/or may serve as a movement mechanism configured to enable the riding assembly 20 and/or the ornamental feature 24 to move generally along the vertical axis 12 and relative to the base 18. In some embodiments, the pole 22 may be omitted from the ride vehicle 10.

During operation of the ride vehicle 10, the rider may sit on the riding assembly 20, and the ride vehicle 10 may traverse the surface 23 of the ride system 11 via the base 18. As described in greater detail below, the ride vehicle 10 may move along a choreographed ride path within the ride system 11 (e.g., along the surface 23 of the ride system 11) and/or may include mechanisms that enable the ride vehicle 10 and/or the riding assembly 20 to move vertically (e.g., generally along the vertical axis 12), to move horizontally (e.g., generally along the longitudinal axis 14 and/or the lateral axis 16), and to roll while moving along the ride path (e.g., to rotate generally about the longitudinal axis 14 and/or the lateral axis 16). The movement of the ride vehicle 10 along the choreographed ride path and/or in the various directions while moving along the ride path may provide entertainment and/or transportation for the rider. For example, the choreography of the ride vehicle 10 and a corresponding choreography of adjacent ride vehicles may generally match a theme of the ride vehicle 10 and/or the ride system. In the illustrated embodiment, the theme may be related to a lion, and the choreography and movement of the ride vehicle 10 may simulate the movement of a lion. Additionally, the movement of the ride vehicle 10 may simulate the movement of a carousel ride vehicle (e.g., the riding assembly 20 may move generally along the vertical axis 12 in an elliptical pattern while moving along the surface 23 of the ride system 11).

Further, the ride system 11 may include additional features that generally match the theme of the ride system 11. For example, the ride system 11 may include audio effects, lighting effects, and other suitable effects within an environment of the ride system 11 that riders may hear, see, feel, or otherwise sense. In the illustrated embodiment, the audio and/or lighting effects may generally be related to a lion and/or a carousel ride system.

Figure 2:
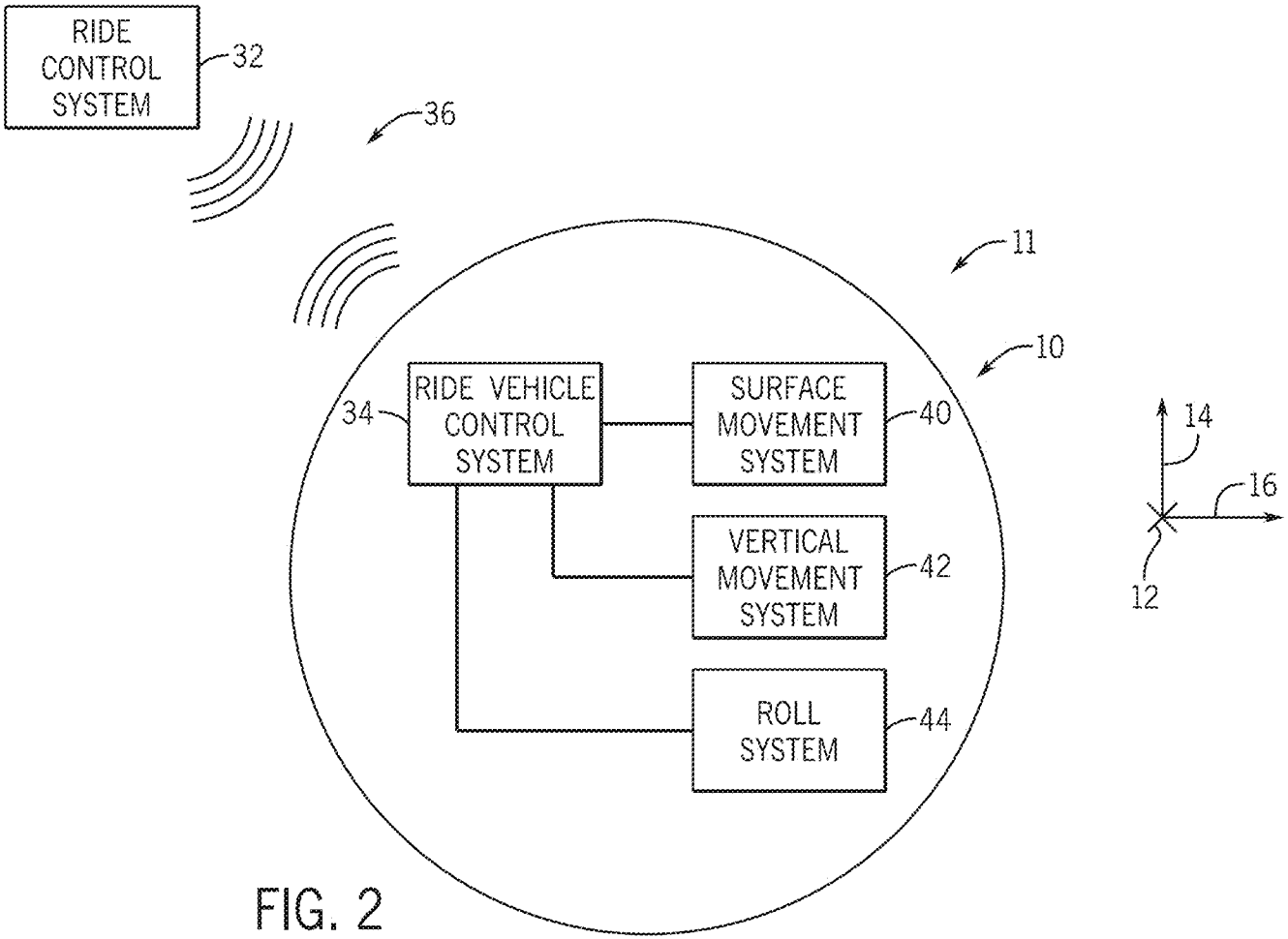
FIG. 2 is a block diagram of an embodiment of the ride system of FIG. 1, in accordance with an aspect of the present disclosure.

FIG. 2 is a block diagram of an embodiment of the ride system 11 of FIG. 1 including the ride vehicle 10. The ride system 11 includes a ride control system 32 in communication with a ride vehicle control system 34 of the ride vehicle 10. As illustrated, the ride control system 32 and the ride vehicle control system 34 are communicatively coupled via a wireless connection 36 (e.g., Wi-Fi, Bluetooth, etc.). In some embodiments, the ride control system 32 and the ride vehicle control system 34 may be communicatively coupled via a wired connection (e.g., Ethernet, universal serial bus (USB), CANbus, ISObus, etc.).

The ride vehicle 10 includes a surface movement system 40, a vertical movement system 42, and a roll system 44 communicatively coupled to the ride vehicle control system 34, such that the ride vehicle control system 34 may control the surface movement system 40, the vertical movement system 42, and the roll system 44. In some embodiments, the surface movement system 40, the vertical movement system 42, and/or the roll system 44 may be directly communicatively coupled to the ride control system 32, such that the ride control system 32 may control the surface movement system 40, the vertical movement system 42, and/or the roll system 44.

The surface movement system 40 may move the ride vehicle 10 along the surface 23 of the ride system 11 generally along the longitudinal axis 14 and/or the lateral axis 16. For example, the surface movement system 40 may move the ride vehicle 10 in any planar direction (e.g., along a plane parallel to the surface 23), may turn the ride vehicle 10, and may spin the ride vehicle 10. The vertical movement system 42 may move the riding assembly 20 generally along the vertical axis 12 relative to the base 18 and/or relative to the surface 23 of the ride system 11. The roll system 44 may roll or angle the riding assembly 20 (e.g., move the riding assembly 20 generally angularly and/or tilt the riding assembly 20) relative to the base 18 and/or relative to the surface 23 of the ride system 11. In certain embodiments, the vertical movement system 42 and/or the roll system 44 may be included in a riding assembly movement system that is configured to move the riding assembly vertically and/or angularly with respect to the base 18.

As such, the ride vehicle control system 34 may control the surface movement system 40, the vertical movement system 42, and the roll system 44 as the ride vehicle 10 moves within the ride system 11 to move the rider seated on the riding assembly 20. By moving the rider as the ride vehicle 10 travels along the ride path within the ride system 11, the ride vehicle 10 may provide an entertaining experience for the rider that simulates movement of a carousel ride system, an animal, a superhero, and/or other entertaining systems or characters.

Figure 3:
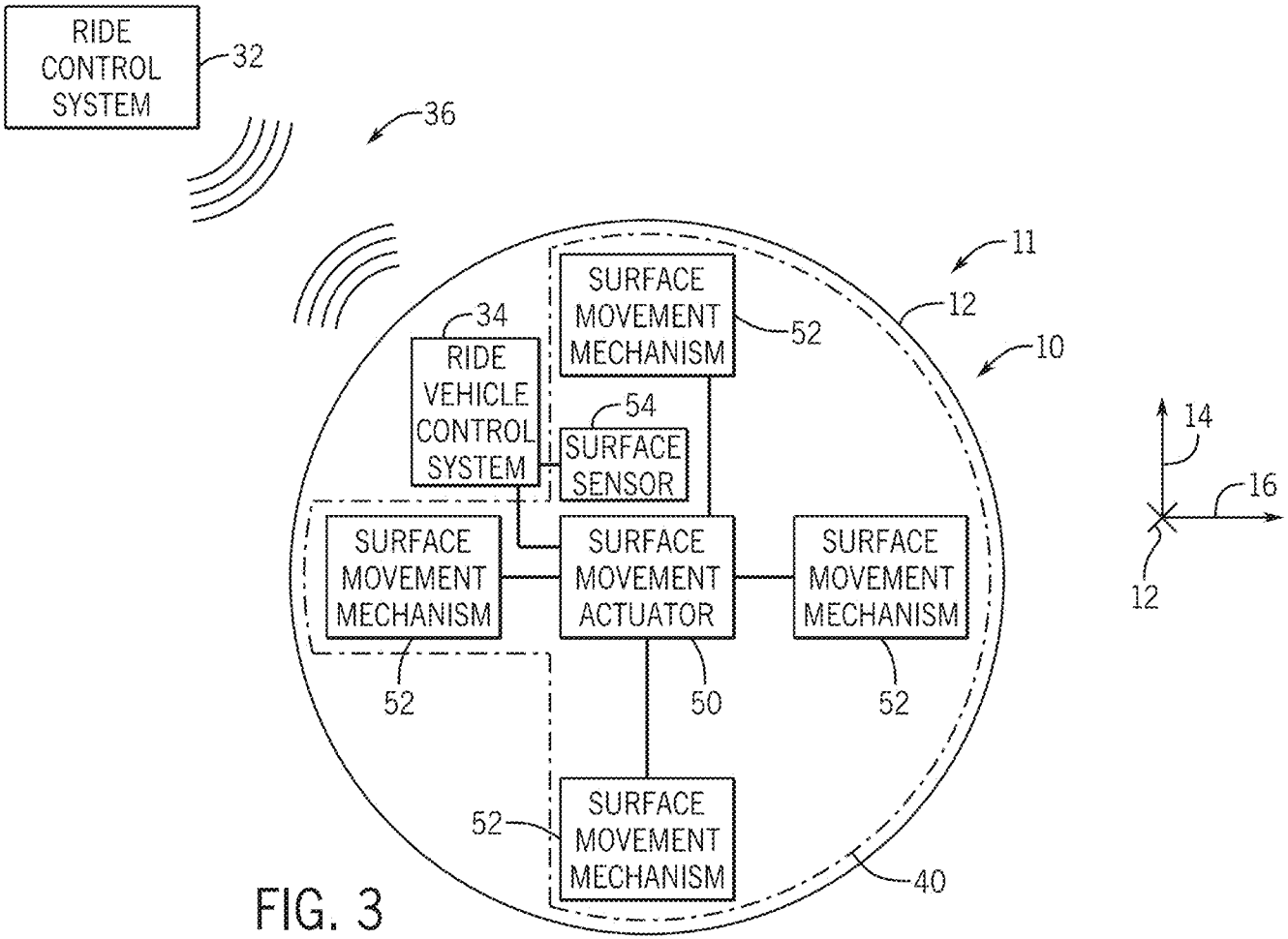
FIG. 3 is a block diagram of an embodiment of the ride system of FIG. 1 including a surface movement system, in accordance with an aspect of the present disclosure.

FIG. 3 is a block diagram of an embodiment of the ride system 11 of FIG. 1 including the surface movement system 40 of the ride vehicle 10. As described above, the surface movement system 40 may move the ride vehicle 10 generally along the longitudinal axis 14 and/or the lateral axis 16 and in any planar direction. The surface movement system 40 may also turn and/or spin the ride vehicle 10 along the surface 23 of the ride system 11. In some embodiments, the surface movement system 40 may turn the ride vehicle 10 in a first direction while spinning the ride vehicle 10 in a second direction. For example, the surface movement system 40 may turn the ride vehicle 10 toward the left while spinning the ride vehicle 10 to the right (e.g., while spinning the ride vehicle 10 clockwise if viewed from a top view).

As illustrated, the surface movement system 40 includes a surface movement actuator 50, surface movement mechanisms 52, and a surface position sensor 54. The surface movement actuator 50 may actuate to cause the surface movement mechanisms 52 to move the ride vehicle 10. For example, the surface movement actuator 50 may be a piston, a hydraulic cylinder, a pneumatic cylinder, another suitable actuator, and the like, and may be coupled to each of the surface movement mechanisms 52. After actuation by the surface movement actuator 50, the surface movement mechanisms 52 may rotate, turn, or perform any other suitable movement to cause the ride vehicle 10 to move along the surface 23 of the ride system 11. For example, the surface movement mechanisms 52 may be wheels, spheres (e.g., steel or rubber balls), another suitable movement mechanism, or a combination thereof. In certain embodiments, the ride vehicle 10 may include more or fewer surface movement mechanisms 52 (e.g., one surface movement mechanism 52, two surface movement mechanisms 52, five surface movement mechanisms 52, etc.).

The surface position sensor 54 may output a signal indicative of a position of the ride vehicle 10 within the ride system 11. For example, the surface position sensor 54 may sense a position of the ride vehicle 10 along the longitudinal axis 14, along the lateral axis 16, relative to another ride vehicle, relative to a ride path, relative to other portions of the ride system 11, along the surface 23, or the like, and output the signal indicative of the position of the ride vehicle 10. The ride vehicle control system 34 may receive the signal indicative of the position of the ride vehicle 10 from the surface position sensor 54. Based on the surface position of the ride vehicle 10, the ride vehicle control system 34 may adjust a trajectory (e.g., a course) of the ride vehicle 10 along the surface 23 of the ride system 11. For example, the ride vehicle control system 34 may output a signal to the surface movement actuator 50 to actuate and cause the surface movement mechanisms 52 to move the ride vehicle 10 along the surface 23 of the ride system 11. In some embodiments, the surface movement actuator 50 may be omitted or may be integral to the surface movement mechanisms 52, such that the ride vehicle control system 34 may communicate directly with the surface movement mechanisms 52 to cause the surface movement mechanisms 52 to move the ride vehicle 10. Additionally, the ride control system 32 may communicate directly with the surface movement system 40, or portions thereof, to control the movement of the ride vehicle 10 along the surface 23 of the ride system 11.

Figure 4:
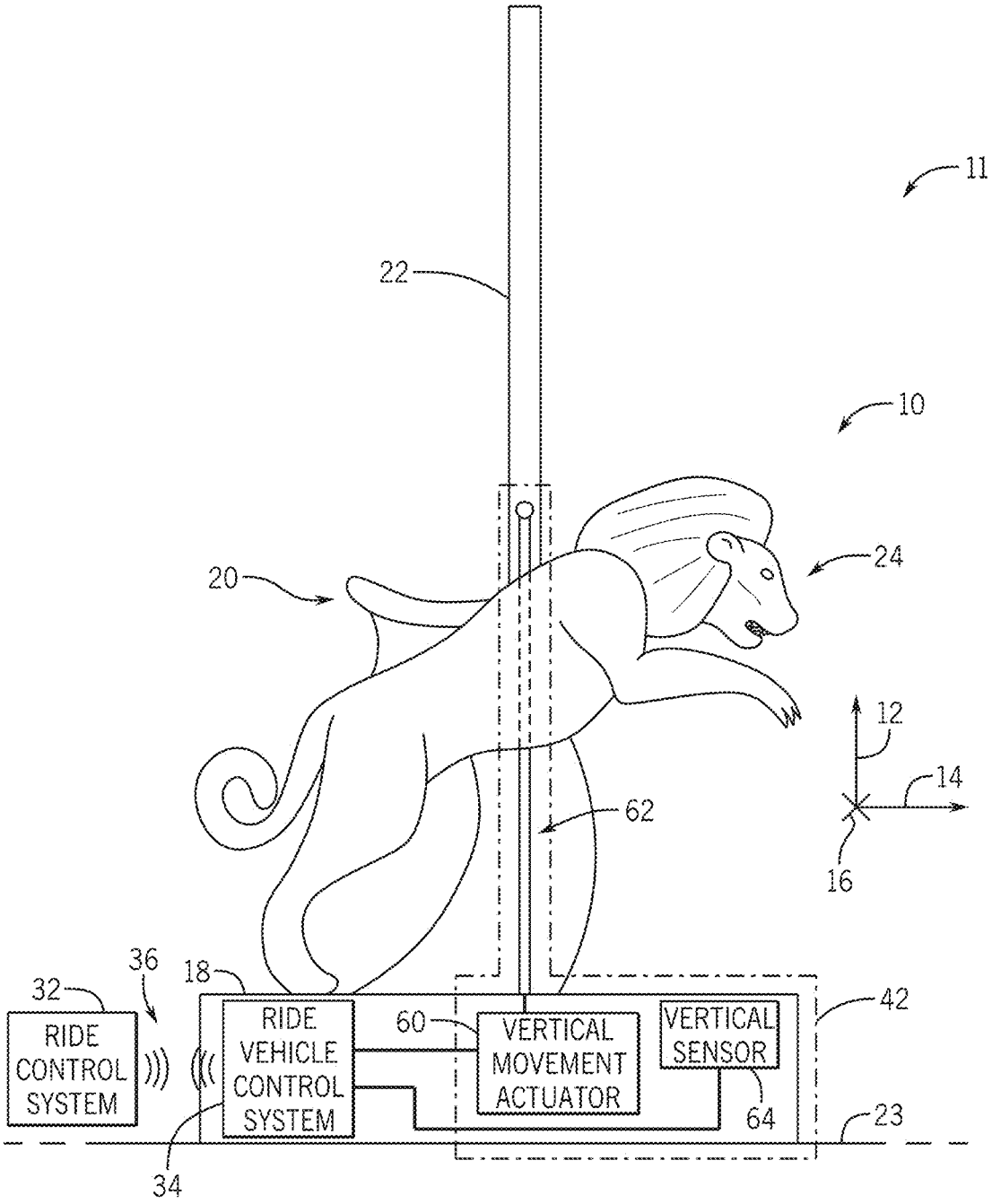
FIG. 4 is a block diagram of a side view of an embodiment of the ride system of FIG. 1 including a vertical movement system, in accordance with an aspect of the present disclosure.

FIG. 4 is a block diagram of a side view of an embodiment of the ride system 11 of FIG. 1 including the vertical movement system 42 of the ride vehicle 10. As described above, the vertical movement system 42 may move the ride vehicle 10 generally along the vertical axis 12 (e.g., generally up, down, and/or in an elliptical motion as the ride vehicle 10 moves within the ride system 11). As illustrated, the vertical movement system 42 includes a vertical movement actuator 60, a vertical movement mechanism 62, and a vertical position sensor 64. The vertical movement actuator 60 is configured to actuate, thereby causing the vertical movement mechanism 62 to move the riding assembly 20 relative to the base 18 and/or the ride vehicle 10 generally. For example, the vertical movement actuator 60 may be a piston, a hydraulic cylinder, a pneumatic cylinder, another suitable actuator, or the like, and may be coupled to the vertical movement mechanism 62. After actuation by the vertical movement actuator 60, the vertical movement mechanism 62 may rotate, turn, or perform any other suitable movement to cause the riding assembly 20 to move generally vertically relative to the base 18. For example, the vertical movement mechanism 62 may include gears that may move along the pole 22, a pulley system, another suitable movement mechanism configured to move the riding assembly 20, or the like. In certain embodiments, the ride vehicle 10 may include additional vertical movement mechanisms 62 (e.g., two vertical movement mechanisms 62, three vertical movement mechanisms 62, five vertical movement mechanisms 62, etc.). The vertical motion of the riding assembly 20 may simulate the motion of a galloping animal, the motion of a carousel ride system, or any other suitable motions associated with the movement of the ride vehicle 10. In some embodiments, the vertical motion caused by the vertical movement system 42 may be combined with the surface movement caused by the surface movement system 40. For example, while the riding assembly 20 moves up or down (e.g., the vertical movement caused by the vertical movement system 42), the surface movement system 40 may turn, spin, or otherwise move the ride vehicle 10 along the surface 23 of the ride system 11

The vertical position sensor 64 may output a signal indicative of a vertical position of the riding assembly 20 relative to the base 18 or a vertical position of the ride vehicle 10. For example, the vertical position sensor 64 may sense a vertical position of the riding assembly 20 along the vertical axis 12 and/or relative to the base 18 and output the signal indicative of the vertical position of the riding assembly 20. The ride vehicle control system 34 may receive the signal indicative of the vertical position of the riding assembly 20 from the vertical position sensor 64. Based on the vertical position of the riding assembly 20, the ride vehicle control system 34 may adjust the vertical position of the riding assembly 20 relative to the base 18. For example, the ride vehicle control system

34 may output a signal to the vertical movement actuator 60 to actuate, thereby causing the vertical movement mechanism 62 to move the riding assembly 20 generally up and/or down. In some embodiments, the vertical movement actuator 60 may be omitted or may be integral to the vertical movement mechanism 62, such that the ride vehicle control system 34 may communicate directly with the vertical movement mechanism 62 to cause the vertical movement mechanism 62 to move the riding assembly 20. Additionally, the ride control system 32 may communicate directly with the vertical movement system 42, or portions thereof, to control the movement of the riding assembly 20. In certain embodiments, the ride control system 32 may control vertical movement of the ride assembly 20 of the ride vehicle 10 based on respective vertical positions of other riding assemblies 20 of other ride vehicles 10. For example, based on another riding assembly 20 of another, separate ride vehicle 10 being at a first vertical position, the ride control system 32 may control the vertical movement/position of the riding assembly 20 of the ride vehicle 10.

Figure 5:
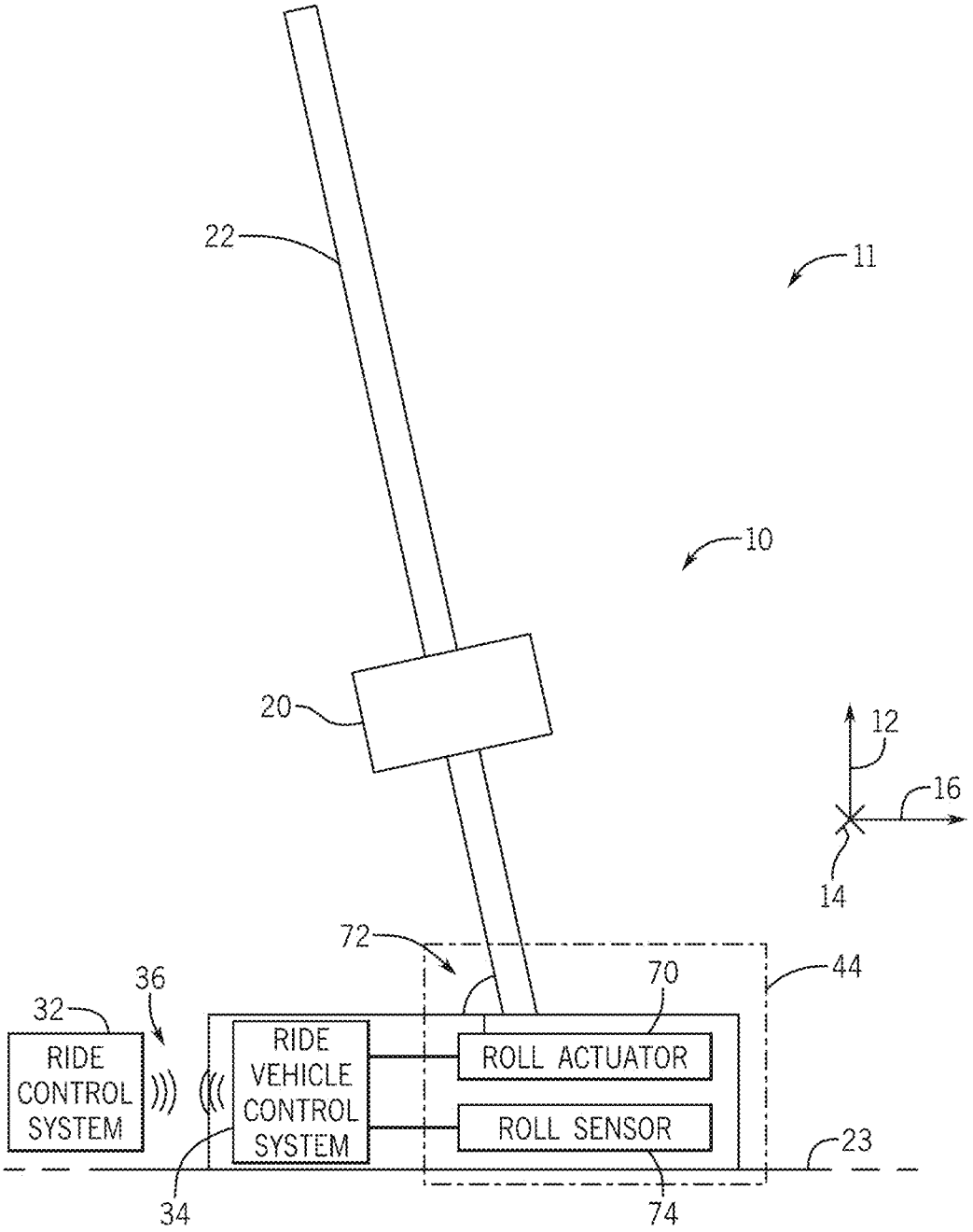
FIG. 5 is a block diagram of a side view of an embodiment of the ride system of FIG. 1 including a roll system, in accordance with an aspect of the present disclosure.

FIG. 5 is a block diagram of a side view of an embodiment of the ride system 11 of FIG. 1 including the roll system 44 of the ride vehicle 10. As described above, the roll system 44 may move the riding assembly 20 generally angularly relative to the base 18 and/or the surface 23 of the ride system 11. As illustrated, the roll system 44 includes a roll actuator 70, a roll mechanism 72, and a roll sensor 74. The roll actuator 70 is configured to actuate, thereby causing the roll mechanism 72 to move the riding assembly 20 generally angularly relative to the base 18 and/or the surface 23 of the ride system 11. For example, the roll actuator 70 may be a piston, a hydraulic cylinder, a pneumatic cylinder, another suitable actuator, or a combination thereof, and may be coupled to the roll mechanism 72. After actuation by the roll actuator 70, the roll mechanism 72 may rotate, turn, or perform any other suitable movement to cause the riding assembly 20 to move generally angularly relative to the base 18. As illustrated, the riding assembly 20 is coupled to the pole 22, and the roll mechanism includes a lever configured to tilt the riding assembly 20 and the pole 22 relative to the base 18 (e.g., move the riding assembly 20 and the pole 22 generally angularly relative to the base 18). In some embodiments, the roll mechanism 72 may tilt the riding assembly 20 relative to the pole 22 and/or the base 18 and may include any other suitable mechanism that may move the riding assembly 20 generally angularly. In certain embodiments, the ride vehicle 10 may include additional roll mechanisms 72 (e.g., two roll mechanisms 72, three roll mechanisms 72, five roll mechanisms 72, etc.). The tilting motion of the riding assembly 20 may simulate the riding assembly leaning into a turn as the ride vehicle 10 traverses the surface 23, via the surface movement system 40, or may simulate other movements associated with the movement of the ride vehicle 10.

The roll sensor 74 may output a signal indicative of an angular position of the riding assembly 20 relative to the base 18 and/or the surface 23. For example, the roll sensor 74 may sense an angular position of the riding assembly 20 about the lateral axis 14 and/or the longitudinal axis 16 and may output the signal indicative of the angular position of the riding assembly 20. The ride vehicle control system 34 may receive the signal indicative of the angular position of the riding assembly 20 from the roll sensor 74. Based on the angular position of the riding assembly 20, the ride vehicle control system 34 may adjust the angular position of the riding assembly 20 relative to the base 18. For example, the ride vehicle control system may output a signal to the roll actuator 70 to actuate, thereby causing the roll mechanism 72 to move the riding assembly 20 generally angularly (e.g., to tilt/lean the riding assembly 20). In some embodiments, the roll actuator 70 may be omitted or may be integral to the roll mechanism 72 such that the ride vehicle control system 34 may communicate directly with the roll mechanism 72 to cause the roll mechanism 72 to move the riding assembly 20. Additionally, the ride control system 32 may communicate directly with the roll system 44, or portions thereof, to control the movement of the riding assembly 20.

Further, the roll movement caused by the roll system 44 may be combined with the surface movement caused by the surface movement system 40 and/or the vertical movement caused by the vertical movement system 42. For example, while the riding assembly 20 is leaning to the left or right (e.g., the roll movement caused by the roll system 44), the surface movement system 40 may turn, spin, or otherwise move the ride vehicle 10 along the surface 23 of the ride system 11 and/or the vertical movement system 42 may move the riding assembly 20 generally vertically relative to the base 18.

Figure 6:
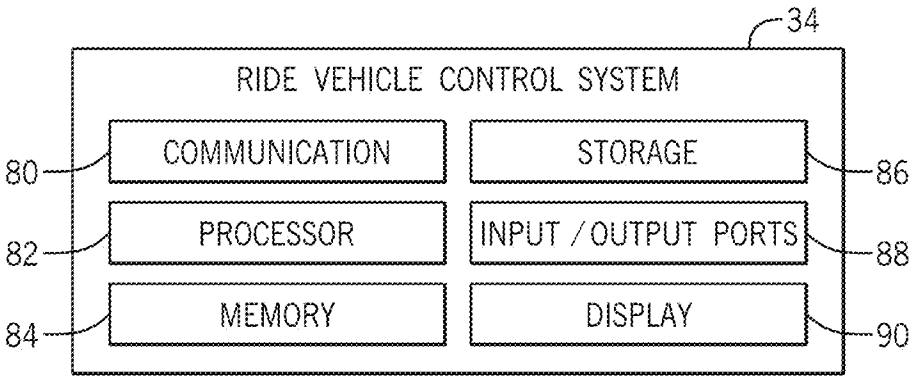
FIG. 6 is a block diagram of an embodiment of a ride vehicle control system of the ride vehicle of FIG. 1, in accordance with an aspect of the present disclosure.

FIG. 6 is a block diagram of an embodiment of example components of the ride vehicle control system 34 of the ride vehicle 10 of FIG. 1. For example, the ride vehicle control system 34 may include a communication component 80, a processor 82, a memory 84, a storage 86, input/output (I/O) ports 88, a display 90, and the like. The communication component 80 may be a wireless or wired communication component that may facilitate communication between the ride vehicle control system 34 and the ride control system 32, the surface movement system 40, the vertical movement system 42, and the roll system 44. For example, the communication component 80 may provide for the wireless connection 36 of FIGS. 2-5 and/or a wired connection.

The processor 82 may be any suitable type of computer processor or microprocessor capable of executing computer-executable code. The processor 82 may also include multiple processors that may perform the operations described below.

The memory 84 and the storage 86 may be any suitable articles of manufacture that can serve as media to store processor-executable code, data, or the like. These articles of manufacture may represent computer-readable media (e.g., any suitable form of memory or storage) that may store the processor-executable code used by the processor 82 to perform the presently disclosed techniques. The memory 84 and the storage 86 may also be used to store the data and various other software applications. The memory 84 and the storage 86 may represent non-transitory computer-readable media (e.g., any suitable form of memory or storage) that may store the processor-executable code used by the processor 82 to perform various techniques described herein. It should be noted that non-transitory merely indicates that the media is tangible and not a signal.

The I/O ports 88 may be interfaces that may couple to other peripheral components such as input devices (e.g., keyboard, mouse), sensors, and input/output (I/O) modules. The display 90 may operate to depict visualizations associated with software or executable code being processed by the processor 82. In one embodiment, the display 90 may be a touch display capable of receiving inputs from a rider of the ride vehicle control system 34. The display 90 may be any suitable type of display, such as a liquid crystal display (LCD), plasma display, or an organic light emitting diode (OLED) display, for example.

It should be noted that the components described above with regard to the ride vehicle control system 34 are exemplary components, and the ride vehicle control system 34 may include additional or fewer components as shown. Additionally, the ride control system 32 may include components similar to those illustrated for the ride vehicle control system 34, such as a communication component, a processor, a memory, a storage, input/output (I/O) ports, and/or a display.

Figure 7:
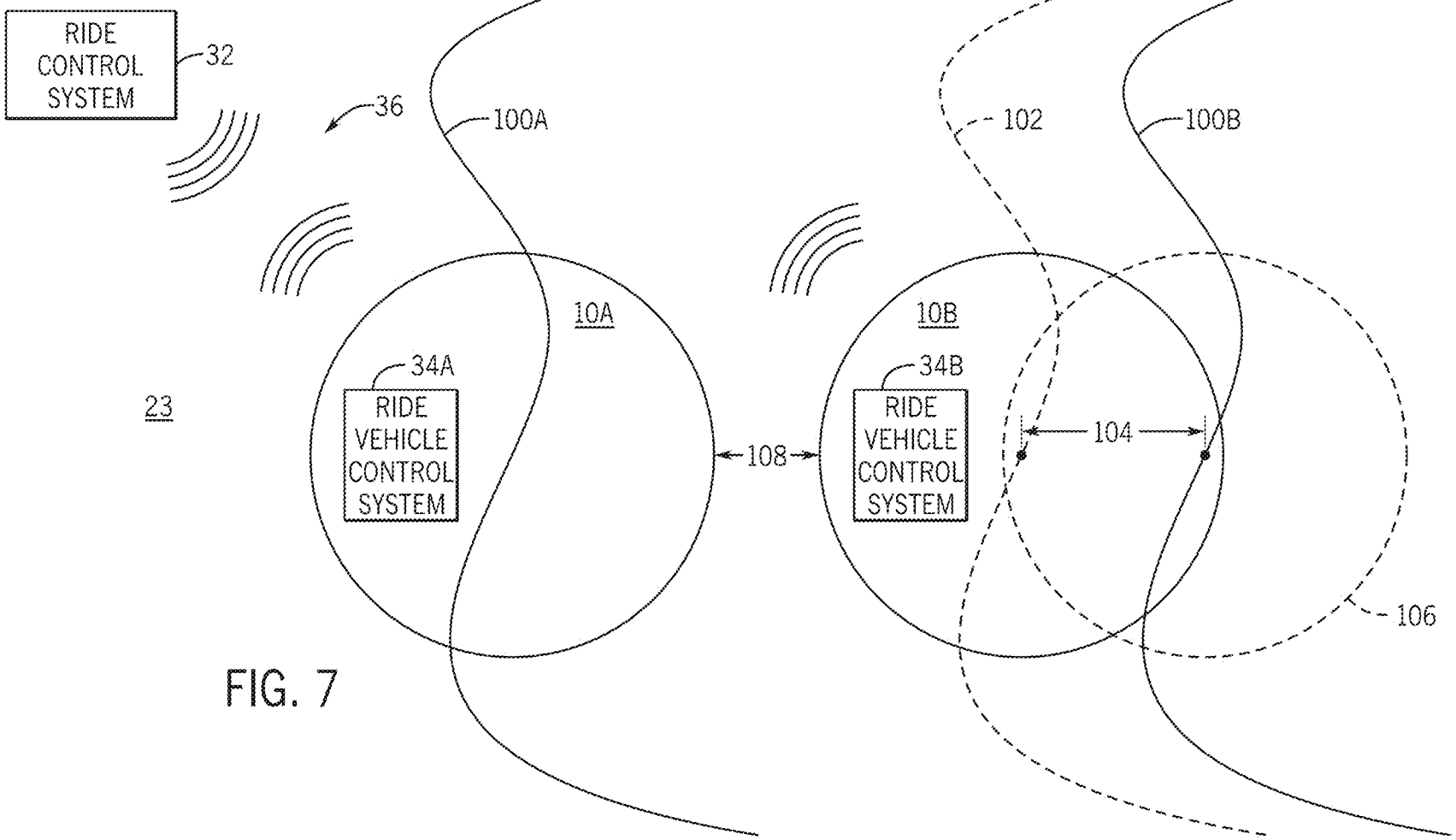
FIG. 7 is a block diagram of an embodiment of the ride system of FIG. 1 having multiple ride vehicles, in accordance with an aspect of the present disclosure.

FIG. 7 is a block diagram of an embodiment of the ride system 11 having ride vehicles 10A and 10B positioned generally adjacent to one another. The ride vehicle 10A may generally follow a ride path 100A that extends along the surface 23 of the ride system 11. The ride vehicle 10B may generally follow a ride path 100B that extends along the surface 23. As illustrated, the ride paths 100A and 100B are generally similar and extend in various directions along the surface 23. In some embodiments, the ride paths 100A and 100B, or portions thereof, may be generally dissimilar and/or may extend in different directions relative to one another. In certain embodiments, the ride vehicles 10 may be trackless such that the ride vehicles 10 may generally move in any direction along the surface 23 and to follow the ride paths 100A and 100B. As described herein, the trackless ride vehicles 10 may move according to the common choreographed routine (e.g., along the ride paths 100A and 100B and other associated movement within the ride system 11) of the ride system 11.

The ride control system 32 and/or each of the ride vehicle control systems 34A and 34B may control the movement of the ride vehicles 10A and 10B to generally follow the ride paths 100A and 100B, respectively. For example, the ride vehicle control system 34A may receive data representative of the ride path 100A (e.g., part of a common choreographed routine) from the ride control system 32. In some embodiments, the common choreographed routine may include transitioning the ride vehicle 10A from a rider boarding area (e.g., a ride queue) to the ride path 100A. As the ride vehicle 10A travels along the surface 23, the ride vehicle control system 34A may receive signals indicative of the position of the ride vehicle 10A, such as signals from the surface position sensor 54. The ride vehicle control system 34A may compare the position of the ride vehicle 10A to a corresponding position along the ride path 100A to determine whether the ride vehicle 10A is following the ride path 100A. For example, the ride path 100A may include multiple positions (e.g., tens, hundreds, or thousands of positions) disposed along the surface 23. The ride vehicle control system 34A may determine whether a distance between the position of the ride vehicle 10A and a corresponding position along the ride path 100A exceeds a threshold ride path distance (e.g., one centimeter, two centimeters, ten centimeters, one meter, two meters, five meters). Based on a determination that the distance between the position of the ride vehicle 10A and the corresponding position along the ride path 100A exceeds the threshold ride path distance, the ride vehicle control system 34A may adjust a trajectory of the ride vehicle 10A to generally return the ride vehicle 10A to the ride path 100A or direct the ride vehicle 10A along the ride path 100A.

In some instances, as the ride vehicles 10 travel along the surface 23, certain factors may affect the trajectory of the ride vehicles 10, such that the ride vehicles 10 may move off course (e.g., a current ride path may differ from an intended ride path). Such factors may include obstacles on the surface 23, a weight of the rider on the ride vehicle 10, a weight of other items disposed on or part of the ride vehicle 10, obstructions attached to the ride vehicle 10 that may be dragging behind, in front of, or the side of the ride vehicle 10, and/or rider inputs (e.g., a rider shifting their weight, a rider turning a steering wheel or adjusting the trajectory of the ride vehicle 10 generally, a rider adjusting a speed of the ride vehicle 10, etc.).

As illustrated, a current ride path 102 of the ride vehicle 10B differs from the intended ride path 100B. For example, the ride vehicle 10B may move from following the intended ride path 100B to following the current ride path 102 based on an obstacle along the intended ride path 100B (e.g., an obstacle detected by sensors of the ride vehicle 10B). The ride vehicle control system 34B may receive a signal indicative of a position of the ride vehicle 10B along the surface 23B. The ride vehicle control system 34B may determine whether a distance 104 between the position of the ride vehicle 10B and the corresponding position along the ride path 100B (e.g., an intended position of the ride vehicle 10B as indicated by a ghost ride vehicle 106) exceeds the threshold ride path distance. Based on a determination that the distance 104 between the position of the ride vehicle 10B and the corresponding position along the ride path 100B exceeds the threshold ride path distance, the ride vehicle control system 34B may adjust a trajectory of the ride vehicle 10B to generally return the ride vehicle 10B to the intended ride path 100B.

In certain embodiments, the ride control system 32 may receive the signals indicative of the positions of each ride vehicle 10 along the surface 23 and may control the trajectory (e.g., the course) of one or more ride vehicles 10 based on the positions relative to one another. For example, the ride control system 32 may receive the signals indicative of the positions of the ride vehicles 10A and 10B and may determine whether a distance 108 between the ride vehicles 10A and 10B is less than a threshold ride vehicle distance (e.g., one centimeter, two centimeters, ten centimeters, one meter, two meters, five meters). Based on a determination that the distance 108 is less than the threshold ride vehicle distance, the ride control system 32 may adjust the trajectory of the ride vehicle 10A and/or the ride vehicle 10B such that ride control system 32 causes the distance 108 to generally increase. In some embodiments, the ride control system 32 may continuously (e.g., periodically every tenth of a second, half of a second, one second, two seconds, five seconds, ten seconds) adjust the course of one or more ride vehicles 10 based on the positioning feedback of at least a subset of other, separate ride vehicles 10.

In certain embodiments, the ride control system 32 and/or the ride vehicle control system 34 may determine the threshold ride path distance and/or the threshold ride vehicle distance for the ride vehicle 10 based on the ride path 100, a weight of the ride vehicle 10, a type of the ride vehicle 10, a size of the ride vehicle 10, a size of the surface 23, a weight of a rider riding the ride vehicle 10, obstacle(s) within the ride area, or a combination thereof. In some embodiments, the ride control system 32 and/or the ride vehicle control system 34 may determine whether the distance between the position of the ride vehicle 10 and the corresponding position along the ride path 100 exceeds the threshold ride path distance, and/or whether the distance between the ride vehicles 10 is less than the threshold ride vehicle distance at periodic intervals during operation of the ride vehicle 10 along the surface 23. The period intervals may be any time period between one tenth of a second and one second, between one second and three seconds, between one second and ten seconds, between five seconds and one minute, or any other suitable time period.

Figure 8:
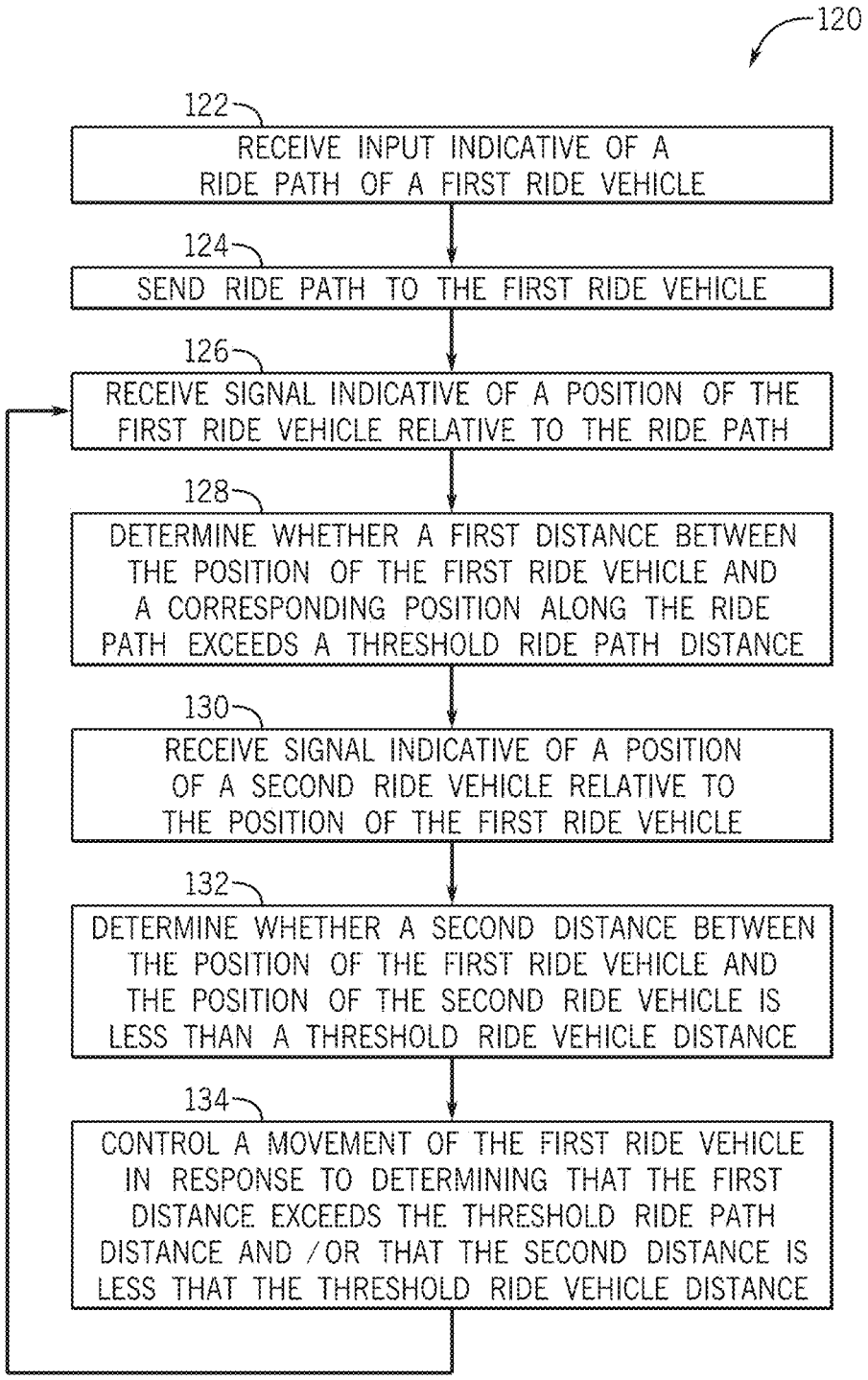
FIG. 8 is a flowchart of a method suitable for controlling the ride system of FIG. 1, in accordance with an aspect of the present disclosure.

FIG. 8 is a flowchart of a method 120 suitable for controlling the ride vehicle 10 and the ride system 11 of FIG. 1. Although the following description of the method 120 is detailed as being performed by the ride control system 32, it should be noted that any suitable computing system may perform the method 120 described below. Moreover, it should be noted that although the method 120 is described below in a particular order, the method 120 may be performed in any suitable order.

At block 122, the ride control system 32 may receive an input indicative of the ride path 100A of the ride vehicle 10A. For example, the ride control system 32 may receive a rider input indicative of a selection of a particular ride path, a choreographed movement (e.g., maneuvers) of multiple ride vehicles 10 that includes a respective ride path 100 for each ride vehicle 10, or any other suitable input. In some embodiments, the rider may be an operator of the ride system 11. Additionally, the rider may be riding the ride vehicle 10 and may provide inputs indicative of a desired experience while riding the ride vehicle 10. The desired experience may correspond to a level of movement of the ride vehicle 10, an intensity the movement of the ride vehicle 10, and other experiences associated with the ride system 11. The ride path 100 for each ride vehicle 10 includes the movement along the surface 23 of the ride system 11 and the motion of the ride vehicle 10 as it moves along the surface 23 (e.g., the spin, vertical/elliptical motion, roll, and turning).

At block 124, the ride control system 32 may send the ride path 100A to the first ride vehicle 10A, such as via the wireless connection 36. The ride control system 32 may also send the ride path 100B to the ride vehicle 10B and other ride paths 100 to other respective ride vehicles 10. In response, the ride vehicle 10A may follow the ride path 100A, and the ride vehicle 10B may follow the ride path 100B.

At block 126, the ride control system 32 may receive a signal indicative of a position of the first ride vehicle 10A. The position of the first ride vehicle 10A may be a position along the surface 23 and along the ride path 100A within the ride system 11 as detected by the surface position sensor 54. In certain embodiments, the ride control system 32 and/or the ride vehicle control system 34 may also receive signals indicative of the vertical position of the ride vehicle 10A and/or the angular position of the ride vehicle 10A from the vertical position sensor 64 and the roll sensor 74, respectively.

To follow the ride paths 100, the ride control system 32 and/or the ride vehicle control system 34 may output signals to the actuators of the ride vehicles 10. For example, based on a particular position along the ride path 100A, the ride vehicle control system 34 may determine that the ride vehicle 10A should be at a surface position, a vertical position, a roll position, and/or should be performing a particular movement (e.g., a spin movement, a roll movement, an elliptical movement, etc.). Based on the position of the ride vehicle 10A along the ride path 100A, the ride vehicle control system 34 may output signals to the surface movement actuator 50, the vertical movement actuator 60, and the roll actuator 70 to perform the appropriate surface, vertical, and roll movement, respectively.

In some embodiments, the ride vehicles 10 may include sensors that may detect obstacles along the ride path 100 and output signals indicative of the presence of the obstacles to the ride control system 32 and/or the ride vehicle control system 34. The ride control system 32 or the ride vehicle control system 34 may control the movement of the ride vehicles 10 to deviate from the ride path 100 and along the surface 23 based on the presence of the obstacles.

At block 128, the ride control system 32 may detect and/or determine whether a first distance (e.g., similar to the distance 104 of FIG. 7) between the first ride vehicle 10A and the corresponding position along the ride path 100A exceeds the threshold ride path distance. As described above, the ride control system 32 may determine whether the first distance exceeds the threshold ride path distance at periodic intervals during operation of the ride system 11. The distance 104 may be caused by the obstacles along the ride path 100A and the movement of the ride vehicle 10A to avoid of the obstacles.

At block 130, the ride control system 32 receives a signal indicative of a position of the second ride vehicle 10B. In some embodiments, the position of the second ride vehicle 10B may be relative to the position of the first ride vehicle 10A. At block 132, the ride control system 32 may detect and/or determine whether a second distance (e.g., the distance 108 of FIG. 7) between the first ride vehicle 10A and the second ride vehicle 10B is less than the threshold ride vehicle distance. As described above, the ride control system 32 may determine whether the second distance is less than the threshold ride vehicle distance at periodic intervals during operation of the ride system 11. In certain embodiments, the inputs indicative of the rider's desired experience while riding the ride vehicle 10A may allow the first ride vehicle 10A to move closer to the second ride vehicle 10B. As such, the rider inputs may cause threshold ride vehicle distance to vary based on the rider's preference.

At block 134, the ride control system 32 may control the movement of the first ride vehicle 10A and/or the second ride vehicle 10B (e.g., by outputting a signal indicative of instructions to adjust the movement of the ride vehicle 10A or 10B) in response to determining that the first distance exceeds the threshold ride path distance and/or that the second distance is less than the threshold ride vehicle distance. For example, as the ride vehicle 10A and 10B move along the surface 23, the ride control system 32 may periodically determine whether the first distance is greater than the threshold ride path distance and/or whether the second distance is less the threshold ride vehicle distance and may control the respective trajectories of the ride vehicle 10A and/or the ride vehicle 10B based on the determinations.

After outputting the signal indicative of instructions to adjust the movement of the ride vehicle 10A or 10B, the method 120 may return to block 126 and may receive the next signal indicative of the position of the first ride vehicle 10A relative to the ride path 100A. The ride control system 32 may iteratively perform blocks 126-134 during operation of the ride system 11 (e.g., as the ride vehicles 10 move within the ride system 11). As such, the ride control system 32 may control the ride vehicles 10 to facilitate the ride vehicles 10 generally following the choreographed ride paths 100 and to prevent the ride vehicles 10 from contacting one another during operation of the ride system 11.

Figure 9:
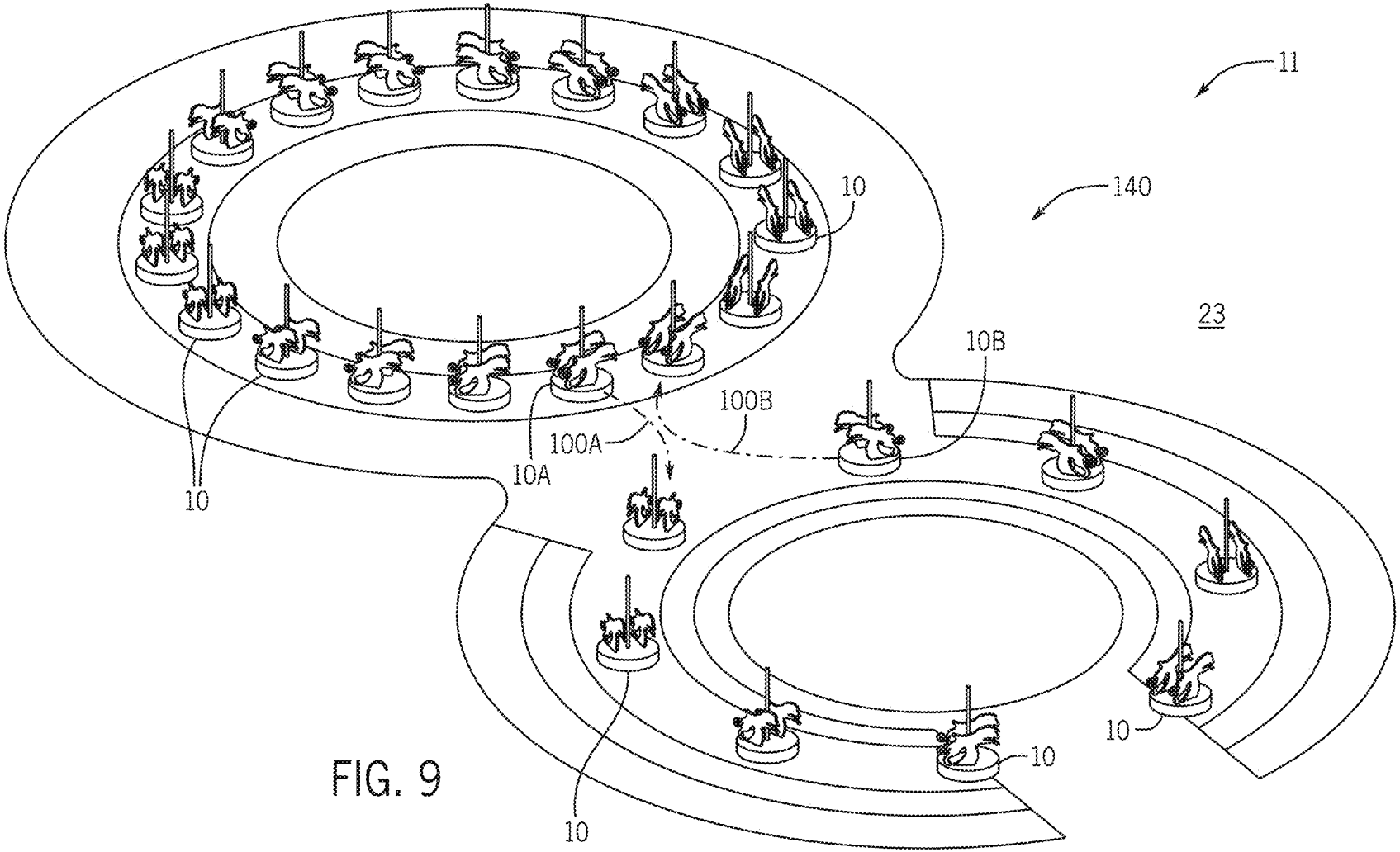
FIG. 9 is a perspective view of an embodiment of the ride system of FIG. 1 having ride vehicles at first respective positions, in accordance with an aspect of the present disclosure.

FIG. 9 is a perspective view of an embodiment of the ride system 11 of FIG. 1 having the ride vehicles 10 disposed at first respective positions relative to one another and relative to their respective ride paths 100 within a ride area 140 of the ride system 11 and along the surface 23. The ride control system 32 and/or the ride vehicle control system 34 of each respective ride vehicle 10 may control the movement (e.g., maneuvers) of each respective ride vehicle 10 within the ride area 140. For example, each ride vehicle 10 may have a respective ride path 100, and the ride paths 100 may be choreographed such that the ride paths 100 generally flow with one another, match one another, match a theme of the ride system 11, or a combination thereof. In the illustrated embodiment, the ride vehicle 10A may follow the ride path 100A, and the ride vehicle 10B may follow the ride path 100B. Additionally, as described above, each ride path 100 may be choreographed to include movement along the surface 23 using the surface movement mechanisms 52, generally vertical movement using the vertical movement mechanism 62, and generally angular movement of the ride vehicles 10 and/or the riding assemblies 20 using the roll mechanism 72 as the ride vehicles 10 travel along the ride paths 100. The ride control system 32 and/or the ride vehicle control system 34 of each respective ride vehicle 10 may control the ride vehicles 10 to generally follow the ride paths 100 and to perform the various vertical, surface, and/or angular movements.

In the illustrated embodiment, the ride system 11 may have a theme related to horses and/or a carousel ride system. As such, the movement of the ride vehicles 10 along the choreographed ride paths 100 may simulate the movement of horses and/or the carousel ride system. Such movement of the ride vehicles 10 may entertain the riders riding the ride vehicles 10 and/or the people viewing the ride vehicles 10. Further, the ride system 11 may include additional features that generally match the theme of the ride system 11. For example, the ride system 11 may include audio effects, lighting effects, and other suitable effects within an environment of the ride system 11 that riders may hear, see, feel, or otherwise sense. In the illustrated embodiment, the audio and/or lighting effects may generally be related to horses and/or a carousel ride system.

As illustrated, the ride system 11 includes twenty-four ride vehicles 10 disposed within the ride area 140 of the ride system 11. In some embodiments, the ride system 11 may include more or fewer ride vehicles 10 (e.g., two ride vehicles 10, three ride vehicles 10, five ride vehicles 10, ten ride vehicles 10, thirty ride vehicles 10, etc.). Additionally, as illustrated, each ride vehicle 10 is configured to carry two riders. In certain embodiments, each ride vehicle 10 may be configured to carry more or fewer riders (e.g., one rider, three riders, four riders, etc.). The illustrated embodiment may include each ride vehicle 10 at a first respective position along a respective ride path 100. As described in greater detail below, FIGS. 10 and 11 illustrate the ride vehicles 10 at second and third positions, respectively, along their ride paths 100.

Figure 10:
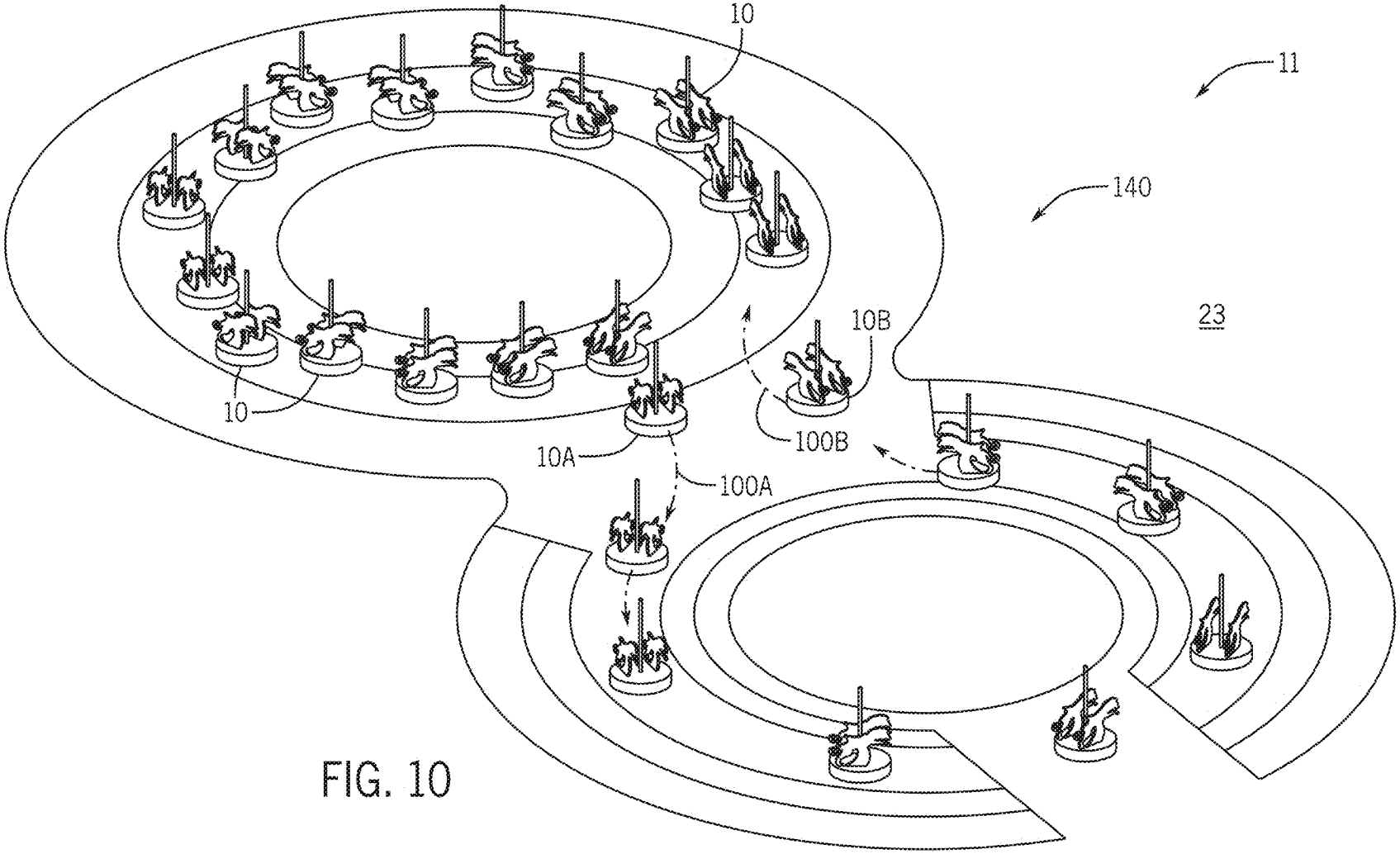
FIG. 10 is a perspective view of an embodiment of the ride system of FIG. 1 having ride vehicles at second respective positions, in accordance with an aspect of the present disclosure.

FIG. 10 is a perspective view of an embodiment of the ride system 11 of FIG. 1 having the ride vehicles 10 at second respective positions relative to one another and relative to their respective ride paths 100 within the ride area 140 of the ride system 11 and along the surface 23. As illustrated, each of the ride vehicle 10A and the ride vehicle 10B have moved from the first positions of FIG. 9 to the second positions of FIG. 10 and along the ride paths 100A and 100B, respectively. Other ride vehicles 10 have also moved within the ride area 140 relative to the positions of FIG. 10.

Figure 11:
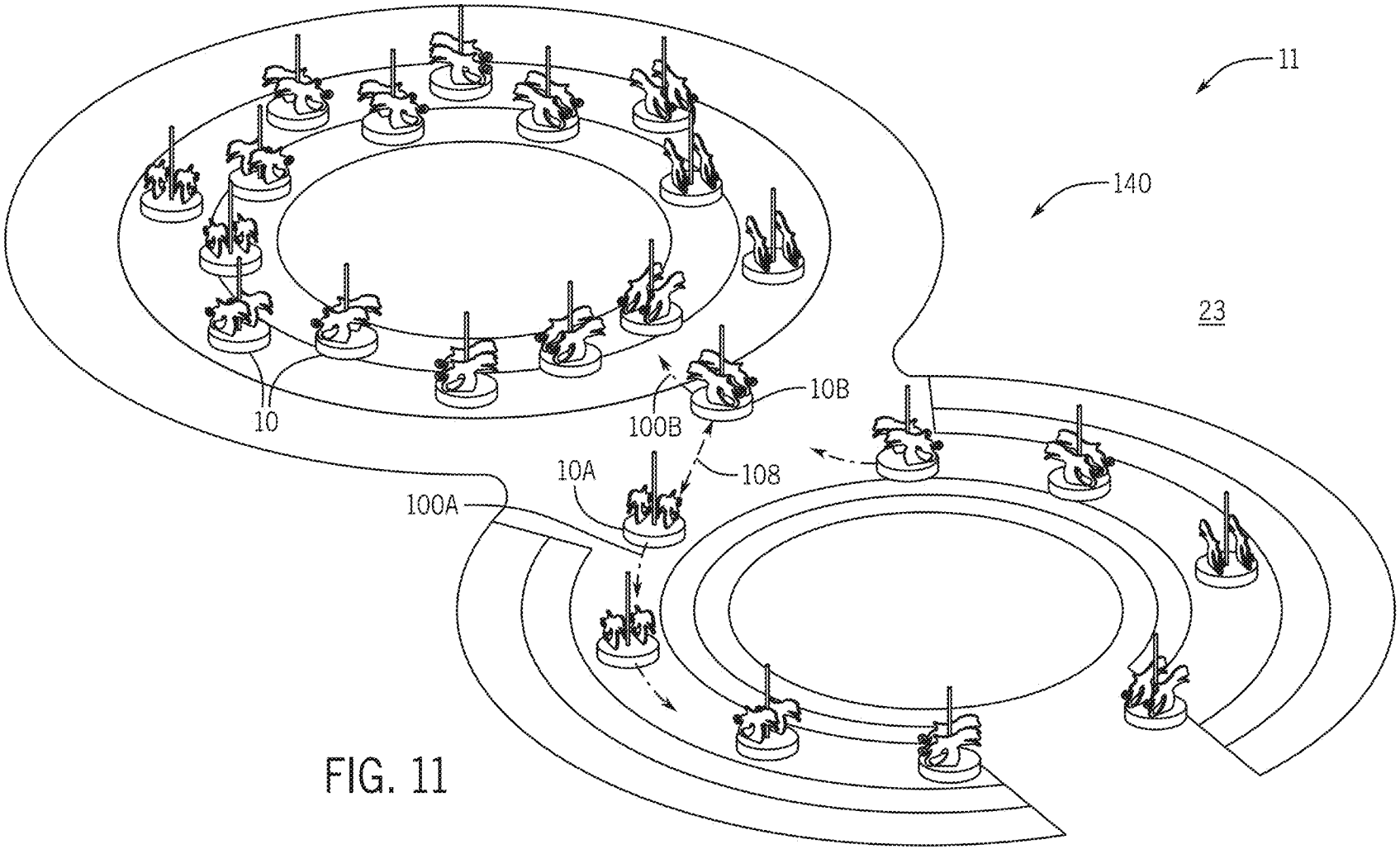
FIG. 11 is a perspective view of an embodiment of the ride system of FIG. 1 having ride vehicles at third respective positions, in accordance with an aspect of the present disclosure.

FIG. 11 is a perspective view of an embodiment of the ride system 11 of FIG. 1 having the ride vehicles 10 at third respective positions relative to one another and relative to their respective ride paths 100 within the ride area 140 of the ride system 11 and along the surface 23. As illustrated, each of the ride vehicle 10A and the ride vehicle 10B have moved from the second positions of FIG. 10 to the third positions of FIG. 11 and along the ride paths 100A and 100B, respectively.

As each ride vehicle 10 moves along a respective ride path 100, the ride control system 32 may control the movement of the ride vehicles 10 to facilitate matching the intended choreography associated with the ride system 11. For example, the ride control system 32 may control the movement of the ride vehicles 10A and 10B to facilitate placement of the ride vehicles 10A and 10B generally at the first, second, and third positions of FIGS. 9, 10, and 11, respectively. As described above, the ride control system may compare the positions of the ride vehicles 10A and 10B to corresponding positions along the ride paths 100A and 100B. The ride control system 32 may control the movement (e.g., adjust the trajectory) of the ride vehicles 10A and/or 10B based on a determination that the distance between the positions of the ride vehicles 10A and 10B and the corresponding positions along the ride paths 100A and 100B exceeds the threshold ride path distance. Additionally, the ride control system 32 may determine whether the distance 108 between the respective positions of the ride vehicles 10A and 10B is less than the threshold ride vehicle distance and control the movement of the ride vehicles 10A and/or 10B based on the determination.

Figure 12:
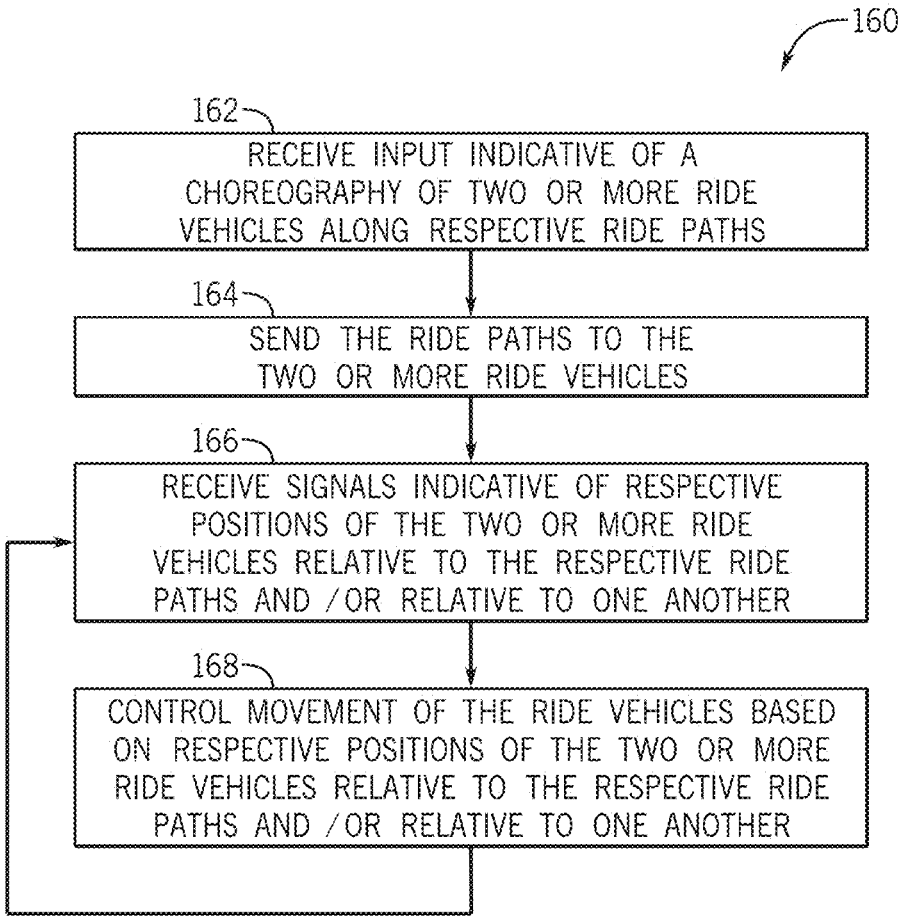
FIG. 12 is a flowchart of a method suitable for controlling the ride system of FIG. 1, in accordance with an aspect of the present disclosure.

FIG. 12 is a flowchart of a method 160 suitable for controlling the ride system 11 of FIG. 1. Although the following description of the method 160 is detailed as being performed by the ride control system 32, it should be noted that any suitable computing system may perform the method 160 described below. Moreover, it should be noted that although the method 160 is described below in a particular order, the method 160 may be performed in any suitable order.

At block 162, the ride control system 32 receives an input indicative of the choreography of the ride vehicles 10 (e.g., two or more ride vehicles 10) along the respective ride paths 100. For example, the input may include a program or other suitable file having the ride paths 100 for each respective ride vehicle 10, among other data. The input may be provided by an operator of the ride system 11 and/or may be received from another system communicatively coupled to the ride control system 32. In some embodiments, the input may be stored in the ride control system 32 and may be retrieved after receiving instructions to operate the ride system 11. Additionally, as described herein, the input may be received from a user (e.g., a rider) riding the ride vehicle 10 or that is about to ride the ride vehicle 10 (e.g., a user in a queue of the ride system 11).

At block 164, the ride control system 32 sends the ride paths 100 to the ride vehicles 10. For example, each ride path 100 may be unique to a particular ride vehicle 10, and the ride control system 32 may output the ride paths 100 to each of the respective ride vehicles 10. The ride vehicle control system 34 may receive the ride paths 100 and may begin operating the ride vehicles 10 to generally follow the ride paths 100.

At block 166, the ride control system 32 receives signals indicative of respective positions of the ride vehicles 10 relative to their respective ride paths 100 and/or relative to one another. For example, the ride vehicle control systems 34 and/or the surface position sensors 54 may output the signals to the ride control system 32.

At block 168, after receiving the positions of the ride vehicles 10, the ride control system 32 may control the movement of the ride vehicles 10 based on their respective positions relative to the ride paths 100 and/or relative to one another. For example, the ride control system 32 may control the movement (e.g., adjust the trajectory) of a particular ride vehicle 10 based on a determination that the distance between the position of the ride vehicle 10 and the corresponding position along the ride path 100 exceeds the threshold ride path distance. Additionally, the ride control system 32 may determine whether the distance 108 between the respective positions of the ride vehicles 10 is less than the threshold ride vehicle distance and control the movement of the ride vehicles 10 based on the determination. In certain embodiments, the ride control system 32 may control movement of the ride vehicles 10 by outputting signals to the ride vehicle control systems 34. For example, the ride control system 32 may output signals to the ride vehicle control systems 34 such that the ride vehicle control systems 34 may coordinate movements of their respective ride vehicles 10 with movements of other (e.g., separate) ride vehicles 10.

After controlling the movement of the ride vehicles 10 based on their respective positions relative to the ride paths 100, the method 160 may return to block 166 and may receive the next signals indicative of respective positions of the ride vehicles 10 relative to their respective ride paths 100 and/or relative to one another. The ride control system 32 may iteratively perform blocks 166 and 168 during operation of the ride system 11 (e.g., as the ride vehicles 10 move within the ride system 11). As such, the ride control system 32 may control the ride vehicles 10 to facilitate the ride vehicles 10 generally following the choreographed ride paths 100 and to prevent the ride vehicles 10 from contacting one another during operation of the ride system 11.

Figure 13:
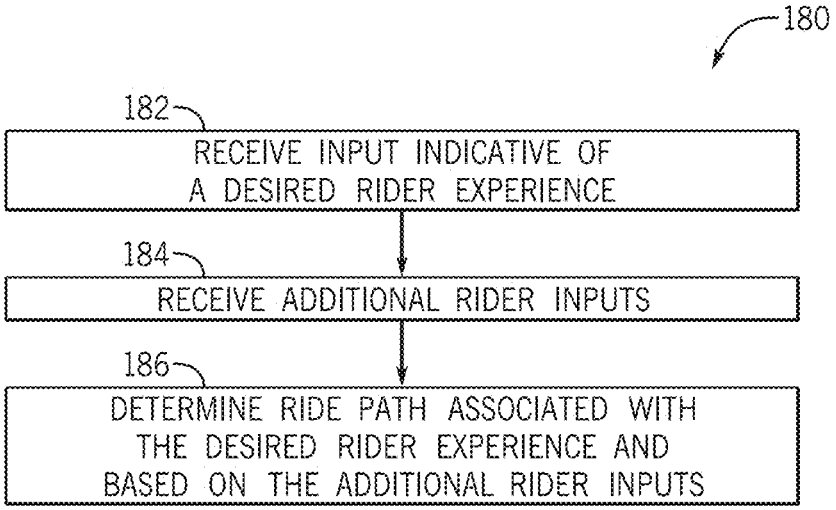
FIG. 13 is a flowchart of a method suitable for controlling the ride system of FIG. 1, in accordance with an aspect of the present disclosure.

As described above, the ride control system 32 may determine the ride path 100 based on rider inputs, such as inputs received from a rider riding the ride vehicle 10 or that is about to ride the ride vehicle 10 and/or an operator of the ride system 11. FIG. 13 is a flowchart of a method 180 suitable for determining the ride path 100 based on rider inputs. Although the following description of the method 180 is detailed as being performed by the ride control system 32, it should be noted that any suitable computing system may perform the method 180 described below. Moreover, it should be noted that although the method 180 is described below in a particular order, the method 180 may be performed in any suitable order.

At block 182, the ride control system 32 may receive an input indicative of a desired rider experience. The rider may be riding the ride vehicle 10, about to ride the ride vehicle 10, and/or in a queue of the ride system 11 waiting to ride the ride vehicle 10. The input provided by the rider may include a desired rider experience, such as a desired intensity level of the ride system 11, a desired theme of the ride system 11, and other preferences of the rider. The desired intensity level may indicate a proximity that the rider may wish to approach various obstacles (e.g., wall, other ride vehicles 10). That is, a first intensity level may correspond to allowing ride vehicles 10 to travel to be within two meters of each other (e.g., the threshold ride vehicle distance), while a second, higher intensity level may correspond to allowing the ride vehicles 10 to travel within one meter of each other to create a sensation in a rider that the ride vehicles 10 may collide. Additionally, the desired intensity level may include the amount of vertical movement and/or roll of the riding assembly 20. For example, the first intensity level may correspond to allowing the ride vehicles 10 to move less vertically and/or to roll less compared to the second, higher intensity level. The desired theme may be a theme related to a movie, a television show, a fictional character, pop culture references, and may include a particular ride path of the ride vehicle 10 and other variations of the ride system 11. For example, if the rider selects a theme related to birds or aircraft, the ride path of the ride vehicle 10 may simulate the flight of a bird or aircraft. Other preferences that may be provided via the rider inputs include language selection, character selection, the rider's height and/or weight, and other similar preferences.

Additionally, at block 184, the ride control system 32 receives additional rider inputs. The additional rider inputs may be received from a different rider relative to the inputs received at block 182. For example, the additional inputs may be received from an operator of the ride system 11 and may include the choreography of the ride vehicle 10, the theme of the ride system 11, the threshold ride path distance, the threshold ride vehicle distance, and other rider inputs. The choreography of the ride vehicle 10 and/or the theme of the ride system 11 may include ride paths 100 that simulate movement of certain objects, such as riding assemblies of a carousel, animals (e.g., horses, dogs, dinosaurs), vehicles (e.g., airplanes, trains, ships, automobiles), and fictional characters (e.g., ghosts, superheroes). The threshold ride path distance may be the minimum distance between each ride path 100, and the threshold ride vehicle distance may be the minimum distance between each ride vehicle 10. In certain embodiments, the theme of the ride system 11 may include the choreography of the ride vehicles 10, the threshold ride path distance, and the threshold ride vehicle distance. As such, the operator may provide a single input (e.g., the theme) to allow the ride vehicles 10 to move along their respective ride paths 100 and based on the threshold ride path distance and the threshold ride vehicle distance.

At block 186, based upon the rider inputs received at blocks 182 and 184 (e.g., the rider inputs received from the rider riding the ride vehicle 10 and from the operator), the ride control system 32 determines the ride path 100 of the ride vehicle 10. For example, the ride control system 32 may determine the ride path 100 based upon the desired intensity level of the ride system 11, the desired theme of the ride system 11, the choreography of the ride vehicle 10 (e.g., the ride paths 100), the threshold ride path distance, the threshold ride vehicle distance, and other rider inputs.

In certain embodiments, the ride control system 32 may adjust an initial ride path 100 and/or may resolve conflicts between the rider inputs when determining the ride path 100. For example, if the operator provides an input indicative of an initial ride path 100 that corresponds to a first intensity level (e.g., block 184), and the rider (e.g., the rider riding the ride vehicle 10) provides an input indicative of a second intensity level that is generally more intense than the first intensity level, the ride control system 32 may adjust the initial ride path 100 provided by the operator to be a higher intensity ride path 100 that corresponds to the second intensity level. The higher intensity ride path 100 may include more relative surface movement, vertical movement, and roll as the ride vehicle 10 travels along the ride path 100 compared to the ride path 100 provided for the first, lower intensity level. Additionally, the higher intensity ride path 100 may allow the ride vehicles 10 to move closer to one another (e.g., the threshold ride vehicle distance may be relatively lower compared to the ride path 100 provided for the first, lower intensity level). As such, via the method 180, the ride control system 32 may provide a customized rider experience that allows the rider to at least partially determine/control the ride path 100 and the choreography of the ride vehicle 10.

As set forth above, the ride system of the present disclosure may provide one or more technical effects useful in enhancing a rider's experience while riding ride vehicles of the ride system. For example, the ride system may include multiple ride vehicles configured to carry riders within a ride area to entertain and/or transport the riders. Movement of the ride vehicles may be choreographed along ride paths and/or with respect to one another and other portions of the ride system and may be controlled by a ride control system and/or ride vehicle control systems. The ride system may determine the ride paths based on various rider inputs, such as operator inputs and inputs indicative of a desired rider experience.

Additionally, the ride vehicles may move in certain directions relative to a surface of the ride system while moving along the ride paths, and/or may include riding assemblies configured to carry the riders and move relative to the surface of the ride system. For example, the ride vehicles may include mechanisms and portions (e.g., the riding assemblies) that may move vertically and/or horizontally in various directions (e.g., may move in any planar direction, may spin, and may turn) and that may roll. As such, the ride vehicles and ride systems described herein may move in various directions and in a choreographed manner for the transportation and/or entertainment of the riders. In certain embodiments, the choreographed movement of the ride vehicles may be viewed by people other than the riders, such as people waiting to ride the ride vehicles. The choreographed movement of the ride vehicles may provide an entertaining attraction for the people viewing the ride system.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride system, comprising:

a plurality of ride vehicles, wherein each respective ride vehicle of the plurality of ride vehicles comprises a riding assembly configured to move vertically and angularly relative to a base of the respective ride vehicle; and a ride control system configured to:

receive a respective position of each respective ride vehicle of the plurality of ride vehicles within a ride area;

determine that a respective distance between two respective positions of two ride vehicles of the plurality of ride vehicles is less than a threshold distance; and output a signal to at least one ride vehicle of the plurality of ride vehicles indicative of instructions to adjust at least one position of the at least one ride vehicle of the plurality of ride vehicles in response to determining that the respective distance between the two respective positions of the two ride vehicles of the plurality of ride vehicles is less than the threshold distance.

2. The ride system of claim 1, wherein the ride control system is configured to determine the threshold distance based on a choreographed routine of the plurality of ride vehicles, one or more weights of the plurality of ride vehicles, one or more types of the plurality of ride vehicles, one or more sizes of the plurality of ride vehicles, one or more additional weights of one or more riders riding the plurality of ride vehicles, one or more rider inputs indicative of one or more desired experiences for the one or more riders, or a combination thereof.

3. The ride system of claim 1, wherein the ride control system is configured to determine whether the respective distance between the two respective positions of the two ride vehicles of the plurality of ride vehicles is less than the threshold distance periodically.

4. The ride system of claim 1, wherein the instructions to adjust the at least one position of the at least one ride vehicle of the plurality of ride vehicles comprise adjusting at least one trajectory of the at least one ride vehicle within the ride area.

5. The ride system of claim 1, wherein each respective ride vehicle of the plurality of ride vehicles comprises a position sensor configured to output the respective position of the respective ride vehicle of the plurality of ride vehicles within the ride area.

6. The ride system of claim 1, wherein the ride control system is configured to output a choreographed routine to the plurality of ride vehicles, and wherein the choreographed routine comprises coordinated maneuvers of the plurality of ride vehicles.

7. The ride system of claim 6, wherein the choreographed routine comprises choreographed movement of the riding assembly and the base of each respective ride vehicle of the plurality of ride vehicles.

8. The ride system of claim 1, wherein the ride control system is configured to:

receive an indication of an obstacle positioned along a ride path of the at least one ride vehicle of the plurality of ride vehicles; and output an additional signal to the at least one ride vehicle of the plurality of ride vehicles indicative of instructions to adjust at least one trajectory of the at least one ride vehicle of the plurality of ride vehicles in response to receiving the indication of the obstacle positioned along the ride path of the at least one ride vehicle of the plurality of ride vehicles.

9. The ride system of claim 1, wherein each ride vehicle of the plurality of ride vehicles comprises a trackless ride vehicle.

10. A ride vehicle, comprising:

a base configured to traverse a ride area;

a riding assembly configured to move vertically and angularly relative to the base; and a ride vehicle control system configured to:

receive a signal indicative of a position of the ride vehicle relative to an additional position of an additional ride vehicle;

determine that a distance between the position of the ride vehicle and the additional position of the additional ride vehicle is less than a threshold distance; and output a signal to the base indicative of instructions to adjust the position of the ride vehicle in response to determining that the distance between the position of the ride vehicle and the additional position of the additional ride vehicle is less than the threshold distance.

11. The ride vehicle of claim 10, wherein the ride vehicle control system is configured to determine the threshold distance based on a choreographed routine, a weight of the ride vehicle, a type of the ride vehicle, a size of the ride vehicle, an additional weight of one or more riders riding the ride vehicle, one or more rider inputs indicative of desired experiences for the one or more riders, or a combination thereof.

12. The ride vehicle of claim 10, wherein the instructions to adjust the position of the ride vehicle comprise adjusting a trajectory of the ride vehicle within the ride area.

13. The ride vehicle of claim 10, wherein the ride vehicle control system is configured to:

receive a choreographed routine comprising coordinated maneuvers of the ride vehicle and the additional ride vehicle; and control the base, the riding assembly, or both, based on the choreographed routine.

14. The ride vehicle of claim 10, comprising a position sensor configured to output the position of the ride vehicle relative to the additional position of the additional ride vehicle.

15. The ride vehicle of claim 10, wherein the base comprises a surface movement system configured to adjust the position of the ride vehicle in response to receiving the signal to the base indicative of instructions to adjust the position of the ride vehicle in response to determining that the distance between the position of the ride vehicle and the additional position of the additional ride vehicle is less than the threshold distance.

16. The ride vehicle of claim 10, comprising a pole extending through the riding assembly, wherein the riding assembly is coupled to the pole.

17. A method, comprising:

receiving a respective position of each respective ride vehicle of a plurality of ride vehicles within a ride area, wherein each respective ride vehicle of the plurality of ride vehicles comprises a riding assembly configured to move vertically and angularly relative to a base of the respective ride vehicle;

determining that a distance between two respective positions of two ride vehicles of the plurality of ride vehicles is less than a threshold distance; and outputting a signal to at least one ride vehicle of the plurality of ride vehicles indicative of instructions to adjust at least one position of the at least one ride vehicle of the plurality of ride vehicles in response to determining that the distance between the two respective positions of the two ride vehicles of the plurality of ride vehicles is less than the threshold distance.

18. The method of claim 17, comprising determining the threshold distance based on a choreographed routine of the plurality of ride vehicles, one or more weights of the plurality of ride vehicles, one or more types of the plurality of ride vehicles, one or more sizes of the plurality of ride vehicles, one or more additional weights of one or more riders riding the plurality of ride vehicles, one or more rider inputs indicative of desired experiences of the one or more riders riding the plurality of ride vehicles, or a combination thereof.

19. The method of claim 17, comprising outputting a choreographed routine to the plurality of ride vehicles, wherein the choreographed routine comprises coordinated maneuvers of the plurality of ride vehicles.

20. The method of claim 19, wherein the choreographed routine comprises choreographed movement of the riding assembly and the base of each respective ride vehicle of the plurality of ride vehicles.

* * * * *